US005221244A

United States Patent [19]

Doss

[11] Patent Number: 5,221,244

[45] Date of Patent: Jun. 22, 1993

[54] BAR BELL

[76] Inventor: Steven G. Doss, 1227 Gunderson Ave., Berwyn, Ill. 60402

[21] Appl. No.: 672,422

[22] Filed: Mar. 20, 1991

[51] Int. Cl.[5] ..... A63B 21/072

[52] U.S. Cl. ..... 482/106; 482/108

[58] Field of Search ..... 272/117, 122, 123, 143; 482/93, 106, 107, 108, 109, 139

[56] References Cited

U.S. PATENT DOCUMENTS

| | | | |
|---|---|---|---|
| 2508,567 | 5/1950 | Dymeck | 272/123 |
| 3,022,073 | 2/1962 | Miller | 272/123 |
| 3,820,781 | 6/1974 | Kane | 272/117 X |
| 3,825,253 | 7/1974 | Speyer | 272/123 |
| 4,076,236 | 2/1978 | Ionel | 272/123 |
| 4,274,628 | 6/1981 | Hoagland | 272/123 |
| 4,351,526 | 9/1982 | Schwartz | 272/122 |
| 4,566,690 | 1/1986 | Schook | 272/123 |
| 4,768,780 | 9/1986 | Hayes | 272/123 X |
| 4,828,256 | 5/1989 | Lee | 272/123 |
| 4,863,158 | 9/1989 | Tassone | 272/123 X |
| 4,997,184 | 3/1991 | Sherman | 272/122 |

FOREIGN PATENT DOCUMENTS

| | | | |
|---|---|---|---|
| 524174 | 8/1921 | France | 272/122 |
| 2600541 | 12/1987 | France | 272/122 |

OTHER PUBLICATIONS

Advertisement by Bockeye Barbae, Inc. In "Muscle & Fitness," Jode 1987.

*Primary Examiner*—Robert Bahr

[57] ABSTRACT

The bar of the bar bell has threaded ends, and weights threaded thereon. The weights have irregular conformations engaging each other as between adjacent weights. The bar has angled elements enabling the user to grasp the bar with the hands at different postures. The weights have non-circular peripheries to prevent rolling. The bar has a center bend to accommodate the user's neck when the bar is placed on the shoulders.

2 Claims, 1 Drawing Sheet

BAR BELL

FIELD OF THE INVENTION

The invention resides in the general field of exercise equipment, and particularly bar bells and dumbells. More specifically the field in which the present invention resides is special construction and advantages of both the bar and the weights in each of the items mentioned, bar bells and dumbbells.

BRIEF SUMMARY OF THE INVENTION

As used herein the expression "bar bell" will include dumbbell unless otherwise specified.

A broad object of the invention is to provide a bar bell having special details of construction to assure that the weights are held on the bar against accidental displacement, either dropping off the bar, or shifting in location on the bar.

Another more specific object is to provide a bar bell of the character just referred to wherein the weights have interengagement as between adjacent weights that functions as a locking effect between those weights.

Still another object is to provide a bar bell of the character just referred to, wherein, because of the interengagement and interlocking effect between adjacent weights, the weights can be positioned at the extreme ends of the bar, whereby, because the bar does not extend out beyond the weights, the bar bell can be stood on end and in that position the weights provide a stable base for holding the bar bell upright.

Another object is to provide a special construction of bar bell that prevents its rolling along a surface, on the weights.

An additional object is to provide a bar bell having a special construction enabling gripping of the bar, in different positions or postures of the hands selectively, for providing variety of exercise in the hands when handling the bar bell.

Still another object is to provide a bar bell for the most part straight but having a special construction in the midportion of the bar, whereby the user can position the bar bell directly over his shoulders and the special construction accommodates the neck of the user, and the weight is imposed directly to the body, through the shoulders.

BRIEF DESCRIPTION OF THE VARIOUS FIGURES OF THE DRAWINGS

DETAILED DESCRIPTION

Figure 1:
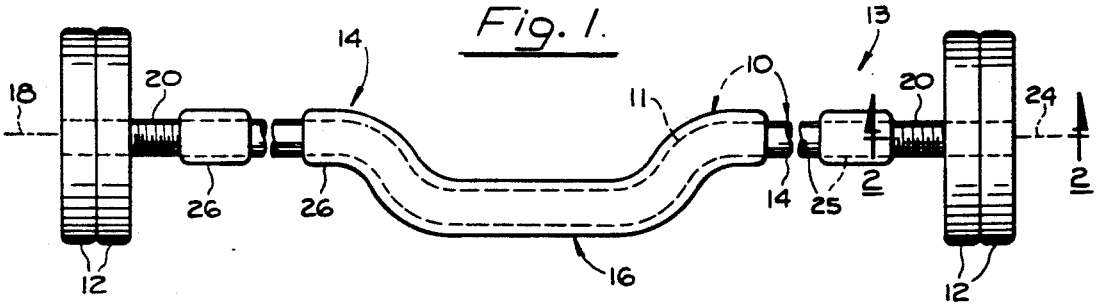
FIG. 1 is a side view of a bar bell incorporating the features of the present invention.

FIG. 1 shows a bar bell 10 including a bar 11 and weights 12, and having outer end portions 13, 14, and a central portion 16 in the form of a bend or half-loop. The end portions 13, 14 have a common longitudinal axis 18 which may be considered the axis of the bar bell. The bend 16 is so shaped and dimensioned to accommodate the neck of the user, as referred to again hereinbelow.

The bar, except for the center bend, lies on the axis throughout its length, and the center bend is relatively small, only large enough to accommodate the user's neck without engaging either the neck or body.

The outer extremities of the bar in the outer end of portions 13, 14, are threaded as indicated at 20, the threads extending for example 6–8".

The bar 11 is of steel, and it may be provided with cushions 26 of suitable material, of known kind, and applied to the bar in a known manner.

A plurality of the weights 12 are provided, two at each end, and mounted on the bar by threading them onto the threaded extremities 20 to a position referred to again hereinbelow.

In the use of the bar bell of the construction shown in FIG. 1, the user grips it at the end gripping portions 26 and lifts it, and in one exercise, it is positioned over the shoulders. In this position, the bend 16 extends around the neck of the user, and the straight outer portions 12, 14, lying on a common axis as referred to above, are positioned directly over the shoulders of the user, and at times actually rest thereon. As a consequence, in the standing position of the user, the weight of the bar bell is imposed directly on the shoulders vertically and thus directly into and through the body in a straight vertical direction. In this position of the bar bell, the bend 16 is of course spaced from the body and does not impose any weight or undesired pressure against the neck or body in any direction.

Figure 4:
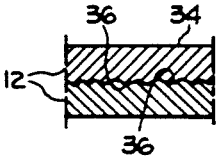
FIG. 4 is a sectional view taken at line 4—4 of FIG. 3.
Figure 2:
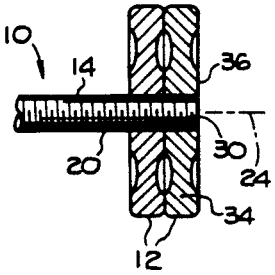
FIG. 2 is a sectional view taken at line 2—2 of FIG. 1.
Figure 5:
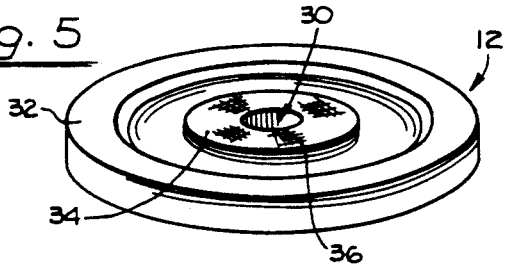
FIG. 5 is a perspective of a weight.

The weights 12 are provided with special constructional features, for which attention is directed particularly to FIGS. 2 and 5. For purposes of describing the main concept of the invention, the weights 12 are shown as being circular and with a smooth peripheral surface, but the invention includes other features of the weights, as described hereinbelow. Each weight has a central threaded hole 30, by which it is threaded on the threaded extremity 20, a peripheral portion 32 and a hub 34, the latter having a surface 36 which for convenience will be referred to as a locking surface. This surface 36 is roughened, and in FIG. 4 is shown highly exaggerated, and instead of the apparent individual high projections of that surface, the surface can be merely a high-friction surface.

Figure 3:
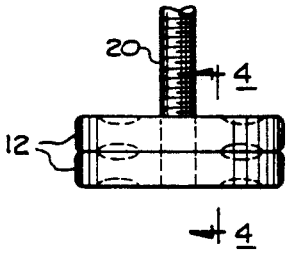
FIG. 3 is a view of the end portion of a bar bell with the weights position at the end of the bar, and turned upright to a standing position.

Two or more weights 12 are mounted on each end of the bar, and the adjacent weights perform an interlocking effect to hold the weights in position. Such an arrangement is shown in FIGS. 2 and 4, where two weights are turned up into interengagement, providing an interlocking effect similar to lock nuts on a bolt. The weights may be positioned anywhere along the threaded extremity 20, and particularly even out to the extreme outer end thereof as represented in FIG. 3. In the latter case, the end of the bar does not extend out beyond the weights, and accordingly the bar bell can be stood on end as shown, in a stable position.

Figure 6:
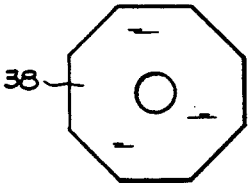
FIG. 6 is a face view of one form of weight.

The invention includes the feature of shaping the weights so that when the bar bell is put on the floor, resting on the weights, it does not roll out of position. FIG. 6 shows a weight 38 of polygonal form, in this case octagonal in shape, for preventing such rolling.

Figure 7:
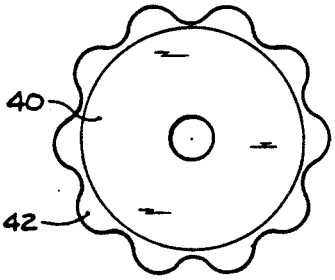
FIG. 7 is a view similar to FIG. 6 of another form of weight.

Another form of weight for preventing rolling of the bar bell out of desired position, is shown in FIG. 7, where a weight 40 is provided with a series of radial projections 42 around its peripherary, preventing rolling of the bar bell from its desired position.

Figure 8:
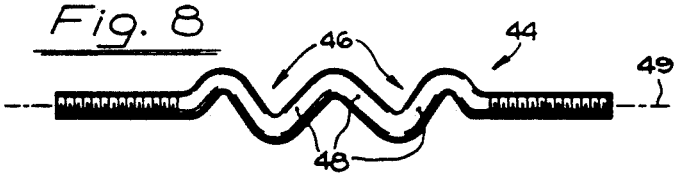
FIG. 8 is a view of a bar, without weights, showing a special construction of elements for gripping the bar.

FIG. 8 illustrates another form of the bar bell having a novel feature of elements at different positions for gripping by the hand. In this case the bar, indicated at 44, has a central portion 46 of zig-zag shape including elements 48 at an acute angle to the longitudinal axis 49 of the bar. These individual elements extend in mutually opposite angular directions, and in gripping the various ones of them, the user's hands are turned at different positions inwardly, outwardly, etc., to provide corresponding exercise effects in the hands. This contrasts with ordinary bar bells that are straight throughout their length that are gripped in only two positions of the hands. In this case the bar is made basically of steel, and is provided with a suitable cushion similar to that of FIG. 1.

Figure 9:
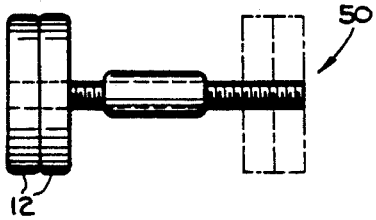
FIG. 9 shows a dumbbell embodying the features of the present invention.

FIG. 9 shows a dumbbell 50, with the weights 12 applied thereto as in the case of the bar bell. All of the features described above, except that of FIG. 8, can be incorporated in a dumbbell with corresponding advantages described above.

I claim:

1. A barbell comprising:

a bar having threaded ends, a plurality of uniformly dimensioned weights having threaded holes extending therethrough, each weight having axially outermost side surfaces extending to the periphery of the weights and the peripheral portions of the weights extending axially at least as far as any other portion of the side surface such that the barbell can be stood on end in a stable position, and a plurality of weights threaded on each end of the bar; and, locking surfaces lying in only a portion of the outermost side surfaces of the weights, the locking surfaces presenting high friction surfaces relative to the remaining outermost side surfaces of the weights, and the locking surfaces of adjacent weights lying in juxtaposition such that when the weights are threaded into interengagement, the respective locking surfaces interengage producing an interlocking effect and holding the weights in position on the bar.

2. A barbell according to claim 1, wherein the bar has a mid portion including a plurality of segments disposed angularly relative to the longitudinal axis of the bar, and adjacent ones of which are disposed at acute angles, enabling the user, in lifting the barbell, to grasp selected ones of the angular segments by positioning the hands at corresponding different positions about the longitudinal axis of the arms.

* * * * *